US006206936B1

(12) United States Patent
Aoyama et al.

(10) Patent No.: US 6,206,936 B1
(45) **Date of Patent: *Mar. 27, 2001**

(54) DYED FILAMENT YARN HAVING CLEAR HUE

(75) Inventors: Saori Aoyama; Togi Suzuki, both of Osaka (JP)

(73) Assignee: Teijin Limited, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/068,209

(22) PCT Filed: Nov. 6, 1997

(86) PCT No.: PCT/JP97/04045

§ 371 Date: May 5, 1998

§ 102(e) Date: May 5, 1998

(87) PCT Pub. No.: WO98/21396

PCT Pub. Date: May 22, 1998

(30) Foreign Application Priority Data

Nov. 12, 1996 (JP) ..... 8-300153

(51) Int. Cl.[7] ..... D06P 1/18; D06P 3/52
(52) U.S. Cl. ..... 8/662; 8/992
(58) Field of Search ..... 139/420; 8/494, 8/922, 662; 57/243

(56) References Cited

U.S. PATENT DOCUMENTS 3,950,130 * 4/1976 Renfrew et al. ..... 8/662
4,026,663 * 5/1977 Huffman et al. ..... 8/922
4,084,622 * 4/1978 Nakagawa et al. ..... 139/420 R
4,089,078 * 5/1978 Botros ..... 8/662
4,211,678 * 7/1980 Henry et al. ..... 260/22 D
5,171,308 * 12/1992 Gallagher et al. ..... 604/372

FOREIGN PATENT DOCUMENTS 56-20626 2/1981 (JP) ..... D02G/3/24
05239373A * 9/1993 (JP) .
6-173114 6/1994 (JP) ..... D01F/6/84
8-325841 12/1996 (JP) ..... D01F/6/84

OTHER PUBLICATIONS

Database WPI, Section Ch, Week 199138, Derwent Publications Ltd., London, GB; Abstract of JP 03 185133 A (Teijin Ltd.) (August 13, 1991)

* cited by examiner

*Primary Examiner*—Kelechi C. Egwin
(74) *Attorney, Agent, or Firm*—Sughrue, Mion, Zinn, Macpeak & Seas, PLLC

(57) ABSTRACT

An aromatic polyester filament yarn dyed in a chromatic color and exhibiting a bright and clear shade, wherein the filaments of the yarn are composed of an aromatic polyester polymer copolymerized with an aliphatic dicarboxylic acid component and/or an aliphatic diol component and having a glass transition temperature (Tg) of not higher than 65° C., the yarn appears as a whole to have been dyed visually uniformly despite that uneven build-up of dye exists in the individual filaments in the longitudinal direction, and the yarn has a chromaticness C* of at least 36 expressed in the L*a*b* color specification system when dyed with an aqueous dispersion of 1% o.w.f. of a disperse dye based on C.I. Disperse Blue 56.

4 Claims, No Drawings

DYED FILAMENT YARN HAVING CLEAR HUE

TECHNICAL FIELD

The present invention relates to a dyed filament yarn exhibiting a bright and clear shade. The present invention relates in more detail to a dyed filament yarn appearing, as a whole, to have been uniformly dyed despite the fact that the individual filaments constituting the yarn have an uneven build-up of dye in the longitudinal direction, and exhibiting significantly improved brightness and clearness.

BACKGROUND ART

Synthetic fibers, particularly polyester fibers show poor color development when dyed, and various investigations have heretofore been carried out on this problem. For example, Japanese Unexamined Patent Publication (Kokai) No. 52-99400 and Japanese Examined Patent Publication (Kokoku) No. 60-37225 disclose an improvement in the deepness of the color of the fibers by imparting a fine unevenness on the surface of the fibers, by plasma etching, so that the absorption of light is increased. Although the method is effective in improving the deepness of black shade mainly caused by absorption of light, substantially no effect of improving the color developing property with respect to a chromatic color is observed.

On the other hand, a method of improving the degree of dyeing of polyester fibers by copolymerizing the polyester polymer constituting the polyester fibers with a third component has been widely known. For example, Japanese Unexamined Patent Publication (Kokai) No. 6-173114 discloses a polyethylene terephthalate yarn obtained by copolymerizing with an aliphatic dicarboxylic acid which has from 4 to 10 total carbon atoms and a glass transition temperature of up to 70° C. The patent publication also discloses that when the yarn is dyed, the yarn shows a high degree of dyeing compared with a conventional polyethylene terephthalate yarn, that is, the dyed yarn shows a low L* expressed in the L*a*b* color specification system recommended by International Illumination Commission (Commission Internationale de l'Eclairage (CIE)) and specified by JIS Z8729-1980.

However, the L* is an index showing the brightness of color, namely, the "deepness of color" of a dyed yarn,. Accordingly, the method is intended to dye a yarn "deeply". In the intention, there is no recognition that the "chromaticness of color" represented by a C* in the L*a*b* color specification system of CIE, i.e., the brightness and clearness are improved.

Furthermore, as disclosed in the patent publication, when the polyethylene terephthalate yarn copolymerized with a third component such as an aliphatic dicarboxylic acid is dyed by a conventional method to merely increase the degree of dyeing (L* being decreased), there arises the problem that the color becomes dark and the brightness and clearness (C*) are rather decreased.

DISCLOSURE OF THE INVENTION

An object of the present invention is to provide a dyed filament yarn which is not only dyed deeply but also dyed to exhibit significantly improved brightness and clearness, i.e., significantly improved "chromaticness of color."

As a result of intensively carrying out investigations to achieve the object, the present inventors have discovered that the brightness and clearness of a filament yarn composed of an aromatic polyester copolymerized with an aliphatic dicarboxylic acid component and/or an aliphatic diol component are significantly improved when the individual filaments constituting the yarn have uneven build-up of dye in the longitudinal direction and the yarn as a whole exhibits a uniform dyed state. The present invention has thus been achieved.

That is, the present invention provides an aromatic polyester filament yarn dyed in a chromatic color and exhibiting a bright and clear shade, wherein (a) the filaments of the yarn are composed of an aromatic polyester polymer copolymerized with an aliphatic dicarboxylic acid component and/or an aliphatic diol component and having a glass transition temperature (Tg) of not higher than 65° C., (b) uneven build-up of dye exists in the individual filaments in the longitudinal direction, (c) the yarn appears as a whole to have been dyed visually uniformly despite the presence of the uneven build-up of dye as mentioned in (b), and (d) the yarn has a chromaticness C* of at least 36, as expressed in the L*a*b* color specification system, when dyed with an aqueous dispersion of 1% o.w.f. of a disperse dye based on C.I. Disperse Blue 56.

Best Mode for Carrying out the Invention

The aromatic polyester filament yarn used in the present invention is composed of an aromatic polyester polymer comprising an alkylene terephthalate, such as ethylene terephthalate, as main repeating unit, and an aliphatic dicarboxylic acid component and/or an aliphatic diol component copolymerized therewith, and having a glass transition temperature (Tg) of not higher than 650° C.

Although such an aromatic polyester polymer is a random copolymer, it shows a distinctive fiber structure in that the crystalline portions and the amorphous portions can be easily separated and that the specific gravity, the birefringence ($\Delta n$) and the dynamic viscoelasticity (tan $\delta$) are low.

Preferred examples of the aliphatic dicarboxylic acid component and the aliphatic diol component are aliphatic dicarboxylic acids having a total number of carbon atoms of 3 to 12, aliphatic diol components having a molecular weight of not more than 300 and their derivatives. Specific examples thereof include succinic acid, adipic acid, sebacic acid, propylene glycol, trimethylene glycol, diethylene glycol, tetramethylene glycol, hexamethylene glycol, neopentyl glycol, 1,8-octanediol, 1,10-decanediol, tetraethylene glycol, and the derivatives of these compounds. Of these compounds, adipic acid and its derivatives are particularly preferred.

When the aliphatic dicarboxylic acid has less than 3 total carbon atoms, the aromatic polyester polymer is not likely to have a glass transition temperature (Tg) of not higher than 65° C. On the other hand, when the aliphatic dicarboxylic acid has a total number of carbon atoms greater than 12, or when the aliphatic diol has a molecular weight exceeding 300, the color fastness tends to decrease.

Moreover, the copolymerization amount of the aliphatic dicarboxylic acid component and/or aliphatic diol component may be arbitrarily selected so that the filaments have a glass transition temperature (Tg) of not higher than 65° C., preferably from 45° C. to 65° C. while the mechanical properties, dyeing properties, etc. are being taken into consideration. When adipic acid and its derivatives are used, they are preferably copolymerized in an amount of 10 to 15% by mole based on the total acid component.

When the glass transition temperature exceeds 65° C., the build-up amount of the dye becomes too small, and the effects of improving the brightness and clearness are difficult to manifest. On the other hand, when the glass transition temperature is too low, the difference in the deepness of color of the uneven build-up of dye present in the filaments in the longitudinal direction becomes too small to manifest the effects of improving the brightness and clearness, as described below, in addition to deterioration of the mechanical properties and a decrease in the color fastness. Accordingly, the glass transition temperature is preferably as low as 45° C.

Stabilizing agents, antioxidants, fire retardants, antistatics, optical brighteners, catalysts, inorganic particles such as titanium oxide, and the like may be added to the polyester filaments so long as the object of the present invention is not impaired.

The polyester filament yarn may naturally be used as a flat yarn. Furthermore, the polyester filament yarn may be used as various finished yarns such as a false-twisted textured yarn, a hard-twisted textured yarn and an air entangling treatment yarn, and yarns in various forms such as a thick and thin yarn and a spun yarn. Still furthermore, the polyester filament yarn may also be used in the form of woven or knitted fabrics, a nonwoven fabric, a raised fabric, and the like.

Moreover, the polyester filament yarn may optionally be used for a mixed knitted fabric, a mixed woven fabric, and the like with natural fibers such as cotton and wool, regenerated fibers such as rayon and acetate and other polyester fibers and synthetic fibers.

The polyester filament yarn of the present invention is dyed in a chromatic color, and uneven build-up of dye exists in the individual filaments constituting the yarn in the longitudinal direction.

The uneven build-up of dye in the longitudinal direction herein refers to unevenness to such a degree that it cannot be recognized as a visually (with the naked-eye) uneven build-up of dye. The appearance of the filament yarn, therefore, appears to be in a uniformly colored state. Accordingly, the state is expressed as "appearing to have been dyed visually uniformly." In particular, when the difference in the brightness L* mentioned above of a yarn is up to 1, the yarn appears to have been dyed visually uniformly.

Furthermore, the presence of the uneven build-up of dye can be confirmed using a transmission fine microscope. A deeply dyed portion 1 having a length of about 45 to 300 $\mu$m and a lightly dyed portion 2 having a L* which differs from the value of the deeply dyed portion in an amount of at least 10 and having a length of about 15 to 150 $\mu$m alternately exist in the filament in the longitudinal direction.

When the filament is a thick or a thin one, the uneven build-up of dye exists independently of unevenness of thickness, and a deeply dyed portion and a lightly dyed portion exist in each of the thick portions and each of the thin portions. That is, in a conventional thick and thin yarn, in addition to the repetition of the variation in thickness at relatively long intervals, the thick portions of the filament are each entirely deeply dyed, while the thin portions thereof are each entirely lightly dyed. Consequently, the yarn does not appear to have been dyed visually uniformly, and the effects of improving the brightness and clearness in the present invention are not manifested.

Furthermore, the filament yarn includes uneven build-up of dye at multi-levels, preferably at least 3 levels among constituent filaments in any of the arbitrarily selected cross-sections (that is, the difference in L* becomes at least 10 among at least 3 filaments). However, the uneven build-up of dye is not manifested at all in the appearance of the yarn.

Next, the process for producing the dyed polyester filament yarn according to the present invention will be explained.

In the present invention the aromatic polyester filament yarn defined in (a) is dyed preferably at temperatures from 90° C. to 105° C. When the dyeing temperature is less than 90° C., the amount of dye build-up becomes insufficient, and the effects of improving the brightness and clearness are difficult to manifest. On the other hand, when the dyeing temperature exceeds 105° C., the dye build-up rate rapidly increases. As a result, the difference in the deepness of color of the uneven build-up of dye becomes too small, in the filament, in the longitudinal and the cross-sectional directions, and the effects of improving the brightness and clearness become difficult to manifest.

The dye used herein is preferably a disperse dye. A disperse dye is a dye which is sparingly soluble in water, and an aqueous dispersion system of which is used in dyeing hydrophobic fibers. The dye is often used in dyeing fibers such as polyester fibers and acetate fibers. Specific examples of the dye include a benzeneazo type dye (monoazo, dis-azo, etc.), a heterocyclic azo type dye (thiazolazo, benzothiazoleazo, qunolineazo, pyridineazo, imidazoleazo, thiopheneazo, etc.), an anthraquinone type dye and a condensed type dye (quinophthalone, styril, coumarin, etc.).

The aromatic polyester filament yarn dyed by the above method shows a significantly improved bright and clear shade compared with an aromatic polyester filament yarn dyed at temperatures from 125° C. to 130° C. which have been conventionally employed in dyeing the yarn.

In general, the brightness and clearness are evaluated by measuring the chromaticness C* expressed in the L*a*b* color specification system recommended by International Illumination Commission (CIE) in addition to visual judging. That is, it may be concluded that among yarns having the same shade and the same deepness, namely, the same brightness L*, a yarn having a larger chromaticness C* is more excellent in brightness and clearness. However, since the C* greatly varies its absolute value depending on the shade, it is preferred that the brightness and clearness of a yarn be evaluated while the type and the deepness of the dye are being specified.

Although the aromatic polyester filament yarn of the present invention is required to have a chromaticness C* of at least 36 expressed in the L*a*b* color specification system when dyed with an aqueous dispersion of 1% o.w.f. of a disperse dye based on C.I. Disperse Blue 56, the yarn also exhibits an improved brightness and clearness when dyed in another chromatic color.

Furthermore, the polyester filament yarn having been dyed is preferably reduction cleaned to remove the dye near the filament surface and enhance the color fastness. Such reduction cleaning treatment is preferably conducted in an alkaline bath at temperature of up to 65° C. When the temperature exceeds 65° C., a certain type of dye exhausted in the interior of the fibers comes to be reduced and decomposed, and the shade may not be reproduced sometimes. When the reduction cleaning temperature is too low, the color fastness becomes poor. Accordingly, the temperature is preferably at least 40° C.

Furthermore, when a neutral bath or an acidic bath is used, the dye near the fiber surface of the filaments is not removed satisfactorily, and the color fastness becomes poor. Accordingly, the baths cannot be used practically. The pH of an alkaline bath is preferably from 9.0 to 13.5. Hydrosulfite is preferably used as a reducing agent, and a surfactant is usually used in combination.

EXAMPLES

The present invention will be further illustrated below with reference to examples, but the invention is in no way restricted by them. In addition, the physical properties in the examples were measured by the following procedures.

(1) Brightness and Chromaticness

The brightness L* and the Chromaticness C* expressed in the L*a*b* color specification system which is recommended by International Illumination Commission (CIE) and specified by JIS Z8729-1980 were measured using a Macbeth COLOR-EYE Model M-2020PL. Among yarns having the same shade and the same deepness, namely, the same brightness L*, a yarn having a larger chromaticness C* is more excellent in brightness and clearness.

(2) Uneven Build-Up of Dye in Filament in the Longitudinal Direction

The presence of uneven build-up of dye in a filament in the longitudinal direction is visually judged using a transmission fine microscope (Olympus SP1100).

(3) Uniformity of Dyed State of Yarn

Whether an entire yarn is uniformly dyed or not is visually judged with the naked eye.

(4) Brightness and Clearness of Yarn

The degree of the brightness and clearness of a yarn is visually judged in accordance with the following three levels: o: significantly bright and clear, Δ: slightly bright and clear, and x: neither bright nor clear.

Example 1

An aromatic polyester composed of a modified polyethylene terephthalate polymer copolymerized with 12.5% by mole of adipic acid was spun at a spinning rate of 1,500 m/min, and drawn 3.5 times at a draw (preheating) temperature of 68° C. and a heat set temperature of 150° C. to form a yarn (50 denier/24 filaments) having a glass transition temperature of 50° C. The yarn was conventionally knitted to give a circular knitted fabric.

The circular knitted fabric was scored in an aqueous solution containing 1 g/l of Score Roll 400 (manufactured by Kao Corporation) at 80° C. for 20 minutes, washed with water, dried and preset at 190° C. for 1 minute.

The circular knitted fabric was then heated at a rate of 2° C./min from room temperature in the following bath, and dyed at a liquor to goods ratio of 30:1 at 98° C. for 60 minutes.

Dye: Resolin Blue FBL a disperse dye based on C.I. Disperse Blue 56) 1% o.w.f.

Dispersing and leveling agent: Disper VG (manufactured by Meisei Kasei K.K.) 0.5 g/l Acetic acid 0.2 ml/l The dyed circular knitted fabric was reduction cleaned in the following bath at 65° C. for 20 minutes.

| | |
|---|---|
| NaOH | 2 g/l |
| Hydrosulfite | 2 g/l |
| Amiladin D (nonionic surfactant) | 2 g/l |

After reduction cleaning, the circular knitted fabric was sufficiently washed, dried, and finally set at 160° C. for 1 minute.

The evaluation results are as shown in Table 1. An aromatic polyester filament yarn exhibiting significantly improved brightness and clearness was obtained.

Examples 2 to 3

The procedure of Example 1 was repeated except that the concentrations of the dye were changed as shown in Table 1. The evaluation results are also shown in Table 1.

Example 4

The procedure of Example 1 was repeated except that the dye was changed to Kayalon Polyester Blue EDL-E (disperse dye based on C.I. Disperse Blue 56) and that the reduction cleaning temperature was set at 80° C. The evaluation results are also shown in Table 1.

Comparative Examples 1 to 3

The procedure of Example 1 was repeated except that the dyeing temperature was set at 130° C. and that the concentrations of the dye were varied as shown in Table 1. The evaluation results are also shown in Table 1.

Examples 5 to 6, Comparative Examples 4 to 5

The procedure of Example 1 was repeated except that the dyeing temperature was varied as shown in Table 1. The evaluation results are also shown in Table 1.

TABLE 1

| | Dyeing temperature ° C. | Concentration of dye % o.w.f. | Uneven build-up of dye in filament in longitudinal direction | Uniformity of dyed state of yarn | Brightness L* | Chromaticness C* | Brightness and clearness |
|---|---|---|---|---|---|---|---|
| Ex. 1 | 98 | 1.0 | present | uniform | 35.4 | 38.2 | ○ |
| Ex. 2 | 98 | 0.5 | present | uniform | 43.1 | 37.2 | ○ |
| Ex. 3 | 98 | 0.2 | present | uniform | 53.6 | 35.0 | ○ |
| Ex. 4 | 98 | 1.0 | present | uniform | 35.2 | 38.0 | ○ |
| Comp. Ex. 1 | 130 | 1.0 | not present | uniform | 36.3 | 34.2 | X |
| Comp. Ex. 2 | 130 | 0.5 | not present | uniform | 44.5 | 34.0 | X |
| Comp. Ex. 3 | 130 | 0.2 | not present | uniform | 54.6 | 31.9 | X |
| Comp. Ex. 4 | 88 | 1.0 | not present | uniform | 40.2 | 32.2 | X |

TABLE 1-continued

| | Dyeing temperature ° C. | Concentration of dye % o.w.f. | Uneven build-up of dye in filament in longitudinal direction | Uniformity of dyed state of yarn | Brightness L* | Chromaticness C* | Brightness and clearness |
|---|---|---|---|---|---|---|---|
| Ex. 5 | 92 | 1.0 | present | uniform | 35.8 | 38.1 | ○ |
| Ex. 6 | 103 | 1.0 | present | uniform | 35.2 | 38.4 | ○ |
| Comp. Ex. 5 | 107 | 1.0 | not present | uniform | 35.0 | 34.8 | X |

Example 7, Comparative Example 6

The procedure of Example 1 was repeated except that the copolymerization amount of adipic acid was varied as shown in Table 2 to obtain aromatic polyester filament yarns each having a glass transition temperature (Tg) different from that in Example 1. The evaluation results are shown in Table 2.

TABLE 2

| | Amount of copolymerized adipic acid (% by mole) | Glass transition temperature (° C.) | Uneven build-up of dye in filament in longitudinal direction | Uniformity of dyed state of yarn | Brightness L* | Chromaticness C* | Brightness and clearness |
|---|---|---|---|---|---|---|---|
| Ex. 7 | 9.0 | 63 | present | uniform | 38.7 | 36.1 | ○ |
| Comp. Ex. 6 | 6.0 | 67 | not present | uniform | 47.3 | 33.5 | X |

Example 8

The procedure of Example 1 was repeated except that a polyethylene terephthalate polymer copolymerized with 9.5% by mole of sebacic acid was used in place of adipic acid to give an aromatic polyester filament yarn (50 denier/24 filaments) having a glass transition temperature (Tg) of about 53° C.

The yarn was knitted, dyed, reduction cleaned, and evaluated in the same manner as in Example 1. The evaluation results are shown in Table 3.

Example 9

The procedure of Example 1 was repeated except that an aromatic polyester filament yarn (50 denier/24 filaments) copolymerized with 11% by mole of 1,8-octanediol and having a glass transition temperature (Tg) of 55° C. was used in place of the adipic acid-copolymerized polyester filament yarn. The evaluation results are also shown in Table 3.

Comparative Example 7

The procedure of Example 1 was repeated except that a polyethylene terephthalate filament yarn (50 denier/24 filaments) containing 0.07% by weight of titanium oxide and having a glass transition temperature (Tg) of 79° C. was used in place of the adipic acid-copolymerized polyester filament yarn. The evaluation results are also shown in Table 3.

TABLE 3

| | Amount of copolymerized adipic acid (% by mole) | Glass transition temperature (° C.) | Uneven build-up of dye in filament in longitudinal direction | Uniformity of dyed state of yarn | Brightness L* | Chromaticness C* | Brightness and clearness |
|---|---|---|---|---|---|---|---|
| Ex. 8 | 9.5 | 53 | present | uniform | 35.7 | 37.4 | ○ |
| Ex. 9 | 11.0 | 55 | present | uniform | 35.9 | 38.2 | ○ |
| Comp. Ex. 7 | — | 79 | not present | uniform | 55.1 | 30.2 | X |

Examples 10 to 14

The procedure of Example 4 was repeated except that the dyes shown in Table 4 were used in place of the dye in Example 4. The evaluation results are shown in Table 4. In addition, the main components of the dyes in Table 4 is shown in parentheses under the dye.

TABLE 4

| | Dye used | Uneven build-up of dye in filament in longitudinal direction | Uniformity of dyed state of yarn | Brightness L* | Chromaticness C* | Brightness and clearness |
|---|---|---|---|---|---|---|
| Ex.10 | Kayalon Polyester Blue GL-SF (C.I. Disperse Blue 165) | present | uniform | 25.2 | 34.6 | ○ |
| Ex.11 | Kayalon Polyester Brilliant Blue FR-S (C.I. Disperse Blue 354) | present | uniform | 45.0 | 48.0 | ○ |
| Ex.12 | Kayalon Polyester Blue BR-SF (C.I. Disperse Blue 183) | present | uniform | 21.2 | 37.5 | ○ |
| Ex.13 | Resolin Red FB (C.I. Disperse Red 60) | present | uniform | 48.6 | 59.4 | ○ |
| Ex.14 | Foron Yellow E-RGFL (C.I. Disperse Yellow 23) | present | uniform | 65.0 | 72.4 | ○ |

INDUSTRIAL APPLICABILITY

The present invention can easily provides a dyed filament yarn which is not only deeply dyed in any chromatic color but also exhibits improved brightness and clearness, namely, improved "chromaticness of color" without using a special apparatus, and the yarn can be appropriately used for clothing, etc.

What is claimed is:

1. An aromatic polyester filament yarn dyed in a chromatic color and exhibiting a bright and clear shade, wherein (a) the filaments of the yarn are composed of an aromatic polyester polymer copolymerized with an aliphatic dicarboxylic acid component and/or an aliphatic diol component copolymerized in an initial or later polymerization of polyester components and have a glass transition temperature (Tg) of not higher than 65° C., (b) uneven build-up of dye exists in the individual filaments in the longitudinal direction, whereby the difference in the brightness L* between deeply dyed portions and lightly dyed portions is at least 10 and the yarn includes at least 3 levels of uneven build-up of dye among the filaments, (c) the difference in the brightness L* of the yarn is up to 1 despite the presence of the uneven build-up of dye as set forth in (b), (d) the yarn has a chromaticity C* of at least 36 expressed in the L*a*b* color specification system when dyed with an aqueous dispersion of 1% of o.w.f. of a disperse dye based on C.I. Disperse Blue 56, (e) the yarn is flat, (f) very fine unevenness of the dye build-up comprising deeply dyed portions of a length of about 45 to 300 $\mu$m and lightly dyed portions of a length of 15 to 150 $\mu$m exist in the individual filaments in the longitudinal direction, and (g) the aromatic polyester filament yarn has been dyed at a temperature from 90° C. to 105° C. and, thereafter reduction cleaned in an alkaline bath having a pH from 9.0 to 13.5 at a temperature from 40 to 65° C.

2. The dyed filament yarn exhibiting a bright and clear shade according to claim 1, wherein the aromatic polyester polymer is copolymerized with an aliphatic dicarboxylic acid component having from 3 to 12 total carbon atoms.

3. The dyed filament yarn exhibiting a bright and clear shade according to claim 1, wherein the aromatic polyester polymer is copolymerized with 10 to 15% by mole of an adipic acid component based on the total acid component.

4. The dyed filament yarn exhibiting a bright and clear shade according to claim 1, wherein the aromatic polyester polymer is copolymerized with an aliphatic diol component having a molecular weight of not more than 300.

* * * * *

UNITED STATES PATENT AND TRADEMARK OFFICE

CERTIFICATE OF CORRECTION

PATENT NO. : 6,206,936 B1
DATED : March 27, 2001
INVENTOR(S) : Saori Aoyama, Togi Suzuki It is certified that error appears in the above-identified patent and that said Letters Patent is hereby corrected as shown below:

Title page, Item (54), and Column 1, Lines 1-2,
Please delete "Dyed filament yarn having clear hue" and insert -- DYED FILAMENT YARN EXHIBITING BRIGHT AND CLEAR SHADE --.

Signed and Sealed this

Eleventh Day of September, 2001

*Attest:*

Nicholas P. Godici

NICHOLAS P. GODICI
*Acting Director of the United States Patent and Trademark Office*

*Attesting Officer*